United States Patent [19]

Cornely et al.

[11] Patent Number: 4,510,180

[45] Date of Patent: Apr. 9, 1985

[54] METHOD OF COATING GEOLOGICAL FORMATIONS AS WELL AS AIR- AND FIRE BARRIERS

[75] Inventors: Wolfgang Cornely, Gladbeck; Heinz Esser; Rudolf Schmidt, both of Burscheid, all of Fed. Rep. of Germany

[73] Assignee: Bergwerksverband GmbH, Essen, Fed. Rep. of Germany

[21] Appl. No.: 466,010

[22] Filed: Feb. 14, 1983

[30] Foreign Application Priority Data

Feb. 19, 1982 [DE] Fed. Rep. of Germany ..... 3205997

[51] Int. Cl.[3] ..... B05C 1/16; B05D 5/10

[52] U.S. Cl. ..... 427/136; 405/264; 405/266; 427/196; 427/426

[58] Field of Search ..... 427/136, 196, 421, 426, 427/427, 393.3, 393.6; 405/263, 264, 265, 266, 270; 404/75

[56] References Cited

U.S. PATENT DOCUMENTS

| | | | |
|---|---|---|---|
| 3,272,098 | 9/1966 | Buchholtz et al. | 427/136 |
| 3,667,998 | 6/1972 | Esser | 427/426 |
| 3,719,050 | 3/1973 | Asao et al. | 405/264 |
| 4,113,014 | 9/1978 | Kubans et al. | 405/264 |
| 4,287,242 | 9/1981 | Monden et al. | 427/426 |

FOREIGN PATENT DOCUMENTS

| | | | |
|---|---|---|---|
| 55-98504 | 7/1980 | Japan | 427/136 |
| 613694 | 12/1948 | United Kingdom | 427/196 |

*Primary Examiner*—S. L. Childs

*Attorney, Agent, or Firm*—Michael J. Striker

[57] ABSTRACT

Coating of geological formations as well as air- and fire barriers is performed by providing aqueous rubber or rubber-like dispersions and spraying the dispersions via separate conduits simultaneously with a dry hydraulic binding medium, by a pressure air onto an object to be coated. An inert filling material can be added to the hydraulic binding medium, and a tenside can be added to the dispersions.

10 Claims, No Drawings

METHOD OF COATING GEOLOGICAL FORMATIONS AS WELL AS AIR- AND FIRE BARRIERS

BACKGROUND OF THE INVENTION

The present invention relates to a method of coating geological formations, as well as air- and fire barriers.

It is known that under the action of water, for example in form of moist air, the strength of clay-containing minerals considerably decreases, which can lead to complete disintegration. In rocks which have a tendency to swell, this process progresses in certain conditions very fast. Particularly in mine and tunnel construction, the water content of such rocks from the outer surface increases very fast, because of high air moisture in the environment, and thereby the moisture of the rock is increased. This is shown, for example, in peeling of rock layers, in stoning, in swelling of the sole and generally in a stronger convergence of the rock, while simultaneously rock movement and pressure are increased. In the event of pillar-and-chamber work in coal mining, this can lead to the situation in which one must excavate top coal in a roof of approximately 30 cm to prevent a collapse of the gallery. By placing a water-impermeable coating layer, the rock susceptible to quelling can be preserved, and a complete excavation of the stratum is made possible.

In underground works, the galleries must frequently be sealed against gaseous air streams. Such streams lead, first of all, in abandoned mine structures to smoldering fires. For preventing this, fire-protective barriers are erected to protect the potential fire zones from an additional oxygen supply. Air barriers are erected to guarantee an exact and effective air supply required for those working at front locations. In general, for this purpose the air- or fire-protective barriers are composed of wood or mineral material. These materials, however, have considerable untightness, first of all in the transition regions barrier-joint and barrier-roof. The air losses are increased by loosening and therefore air-permeability of the adjoining rock. The leakages in the barrier are conventionally sealed by urea formaldehyde foam. During rock movement, small cracks can, however, generate in the coating, particularly in the event of utilization of mortar, so that the barrier is no longer tight. Similarly, during pillar-and-chamber work, high air losses take place because the coal of the field to be evacuated is air-permeable toward the adjoining field.

German patent No. 1,082,876 discloses a method of sealing air- or fire barriers by simultaneous spraying of a latex dispersion and a filling medium. Thereby an air- and liquid-tight film is applied. The fire-resistance of this film is, however, not satisfactory.

SUMMARY OF THE INVENTION

Accordingly, it is an object of the present invention to provide a method of coating of geological formations as well as air- and fire barriers, which avoids the disadvantages of the prior art.

In keeping with these objects and with others which will become apparent hereinafter, one feature of the present invention resides, briefly stated, in a method of coating geological formations as well as air- and fire barriers, in accordance with which latex dispersions are sprayed via separate conduits simultaneously with a dry hydraulic binding medium, by a pressure air onto an object to be coated.

The novel features which are considered characteristic for the invention are set forth in particular in the appended claims. The invention itself, however, both as to its construction and its method of operation, together with additional objects and advantages thereof, will be best understood from the following description of specific embodiments.

DESCRIPTION OF THE PREFERRED EMBODIMENTS

A method of coating geological formations and air- and fire barriers in accordance with the present invention includes spraying of rubber or rubber-like dispersions via separate conduits (tubes) simultaneously with a dry hydraulic binding medium, by a pressure air onto an object to be coated.

With the aid of a hydraulic binding medium, particularly cement, a double action is obtained. The cement acts first of all as a coagulating medium for the dispersion, and moreover as a medium for strengthening (hardening) of the respective coating. The method in accordance with the present invention uses, for example, a gunite apparatus in which the hydraulic binding medium is transported by pressure air, but instead of water an aqueous rubber or plastics dispersion is introduced at the outlet end of the transport pipe, so that a mixture of binding medium and dispersion is sprayed from the transport pipe.

The portion of rubber can be varied in wide limits. It is possible to provide this portion up to 50% by weight, relative to the cement or other hydraulic binding medium. 5–20% by weight of solid matter portion in the dispersion is advantageous. In the event of low portion of the rubber, it is necessary to add to the dispersion additional water, so as to have available water required for the hydraulic hardening step.

Apparatuses which are normally used for gunite methods can be utilized in principle for the inventive method. It has been found advantageous, however, when the bores of the nozzle, through which normally water and in this case latex is supplied, are designed so that the latex uniformly moistens the stream of binding medium over its entire cross section. For this purpose the originally radial bores of the nozzle are changed so as to extend in a tangential direction. By this feature a uniform moistening of the mixture of the binding medium with latex takes place and the unavoidable rebound of the binding medium from the sprayed outer surfaces is reduced to a minimum.

The type of dispersion to be used depends upon the type of cement used in the inventive method. In accordance with the present invention, when Portland cement or blast furnace cement or a similar quick binding cement is used as a binding medium, it is advantageous to use cationic or amphoteric lattices, whereas with the utilization of high -alumina cement or similar quick binding cement or anionic-non-anionic lattices are mainly used.

Various lattices and synthetic plastic dispersions are suitable for the inventive process. However, because of particularly high requirements to the high inflammability in the event of utilization in coal mining, only those latices are in question which have a high halogen portion, for example latices based on poly-2-chlorobutadiene or composite polymerizates of 2-chlorobutadiene and dichlorobutadiene. In the event that no firing danger is present, the following dispersion can be used:

| | | |
|---|---|---|
| (A) | natural latex | 6% by weight solid content |
| (B) | butadiene-acrylonitrile latex | 45% by weight solids content |
| (C) | styrene-butadiene latex | 66% by weight solids content |
| (D) | acrylate latex | 50% by weight solids content |
| (E) | anionic polychloroprene latex | 58% by weight solids content |
| (F) | polyurethane latex | 48% by weight solids content |
| (G) | cationic polychloroprene latex | 55% by weight solids content |
| (H) | amphoteric polychloroprene latex | 58% by weight solids content |
| (I) | polybutadiene latex | 49% by weight solids content |
| (K) | carboxylated stearin-butadiene latex | 50% by weight solids content |
| (L) | vinyl-pyridine latex | 40% by weight solids content |
| (M) | polyvinylchloride dispersion | 52% by weight solids content |
| (N) | polyvinylacetate dispersion | 50% by weight solids content |

Spraying of the latices into a stream composed of dry binding medium is performed in a suprising and unexpected manner without disturbances, even when the nozzles through which the latices are present have a diameter of only 0.5 to 2 mm. There was a concern that, because during spraying the shearing forces act on the latices, coagulation would take place and thereby can lead to clogging of the nozzle.

The sprayed mixture of latex and binding medium has a tendency, in dependence upon inclination of the surface to be sprayed, to flow off from this surface. This tendency is counteracted in accordance with the present invention when the binding medium, particularly cement, is used with especially short hardening time, namely 10–150 min, advantaeously 30–90 min, measured in accordance with the German Industrial Standard 164.

By adding inert filling materials to the binding medium, a premature flowing off of the sprayed mixture can also be successfully prevented. Advantageously, as the filling material all non-quartz-containing filling materials, since flinging of the sprayed mixture can be avoided with difficulties and inhaling the thus produced rebounded quartz-containing smog is health-hazardous for the user. Advantageously, in accordance with the present invention refractory materials from coarse grain to fine powder can be added to the binding medium in a quantity eight times exceeding the latter.

For maintaining the stability of the dispersion also during spraying outwardly of the nozzle, it is recommended to add tensides in small quantities to the latices. For example, cationic or amphoteric latices can be provided with tensides in quantities up to 0.2–1%, and anionic or anionic/non-anoic latices can be provided with tensides with respective characteristics.

In any case, the dispersions must have high flowing properties, their solid matter content must be between 30 and 70% by weight.

EXAMPLE 1

In a trial tunnel with a cross section of 12 $m^3$ a quick barrier is erected so that an elastic covering with the aid of a gunite apparatus is sprayed in an average thickness of 20 mm against a suspended-wire grate extending over the entire cross section. The hydraulic binding medium is composed of a high-alumina cement with a hardening time of 60 minutes. The synthetic plastic dispersion composed of a 55% polychloroprene dispersion Baypren latex B is added to the cement with ratio of 9:1 (binding medium:dispersion).

The original air quantity of 850 $m^3$/min is reduced behind the covering immediately to 4 $m^3$/min, and a pressure drop between the gallery space forwardly and rearwardly of the quick barrier is equal to 520 pa. In the event of increase of the pressure drop to 1020 pa or 2450 pa by the increase of the air power, the air quantity behind the covering does not exceed 5 $m^3$/min or 11 $m^3$/min.

The head gallery of an abundant mine with a cross section of 16 $m^2$ is closed with a barrier of brickwork. The air quantity in the gallery decreases thereby from 1650 $m^3$/min to 4.5 $m^3$/min. After this, a layer with an average thickness of 50 mm of conventional gun concrete is applied by a gunite apparatus onto the barrier and onto the gallery edge and roof over a distance to 4 meters from the barrier. Thereby the air quantity behind the barrier is reduced to 0.8 $m^3$/min. After this, the air quantity behind the barrier increases to 1.2 $m^3$/min, after 4 weeks to 2.0 $m^3$/min. First cracks in the gun concrete become visible first after 6 weeks starting from chipping off of individual pieces from the barrier. The air quantity increases to 2.8 $m^3$/min after 2 months.

After this, with a gunite apparatus a new barrier is erected, and there is applied latex-containing gun concrete which is composed of amphoteric polychloroprene latex, on the one hand, and a mixture of granular to powdery chamote and Portland cement with a hardening time of 60 minutes in the ratio 3:1, on the other hand. It is applied with an average thickness of 25 mm. The air quantity reduces to 0.5 $m^3$/min and after 2 months does not exceed the value of 1.2 $m^3$/min.

It will be understood that each of the elements described above, or two or more together, may also find a useful application in other types of methods differing from the types described above.

While the invention has been illustrated and described as embodied in a method of coating geological formations as well as air- and fire barriers, it is not intended to be limited to the details shown, since various modifications and structural changes may be made without departing in any way from the spirit of the present invention.

Without further analysis, the foregoing will so fully reveal the gist of the present invention that others can, by applying current knowledge readily adapt it for various applications without omitting features that, from the standpoint of prior art, fairly constitute essential characteristics of the generic or specific aspects of this invention.

What is claimed as new and desire to be protected by Letters Patent is set forth in the appended claims:

1. A method of coating geological formations as well as air- and fire barriers, comprising the steps of providing an aqueous rubber or rubber-like dispersion; providing a dry hydraulic binding medium; and spraying the aqueous rubber or rubber-like dispersions and the dry hydraulic binding medium simultaneously but via separate conduits by a pressure air onto an object to be coated.

2. A method as defined in claim 1, wherein said spraying step includes spraying via the conduits formed as tubes.

3. A method as defined in claim 1, wherein said spraying step includes using the dry hydraulic binding medium with a hardening time of 10–150 min.

4. A method as defined in claim 3, wherein said spraying step includes using the hydraulic binding medium with a hardening time of 30–90min.

5. A method as defined in claim 1, and further comprising the step of adding to the hydraulic binding medium an inert filling material with a weight quantity of the latter which at most 8-times exceeds the weight quantity of the former.

6. A method as defined in claim 1, and further comprising the step of adding a tenside to the dispersions to be sprayed.

7. A method as defined in claim 1, wherein said spraying step includes using the dispressions with a content of solid matter equal to 30–70%.

8. A method as defined in claim 1, wherein said spraying step includes using the dispersions with a content of solid matter equal to 5–20% of the binding medium.

9. A method as defined in claim 1, wherein said spraying step includes using a dispersion of polychlorophene as the rubber dispersion.

10. A method as defined in claim 1, wherein said spraying step includes using cement as the dry hydraulic binding medium.

* * * * *

UNITED STATES PATENT AND TRADEMARK OFFICE

CERTIFICATE OF CORRECTION

PATENT NO. : 4 510 180

DATED : April 9,1985

INVENTOR(S) : Wolfgang Cornely,Heinz Esser and Rudolf Schmidt

It is certified that error appears in the above-identified patent and that said Letters Patent are hereby corrected as shown below:

On the title page:

In the heading (73), the names of the assignees should read:

--Bergwerksverband GmbH,Essen,Federal Republic of Germany and Bayer AG, Leverkusen ,Federal Republic of Germany--

Signed and Sealed this

Nineteenth Day of April, 1988

*Attest:*

DONALD J. QUIGG

*Attesting Officer*

*Commissioner of Patents and Trademarks*